US009839269B2

(12) United States Patent
Chen

(10) Patent No.: US 9,839,269 B2
(45) Date of Patent: Dec. 12, 2017

(54) LUGGAGE CONTAINER WITH ADJUSTABLE INTERIOR SPACE

(71) Applicant: Solite International Co., Ltd., Changhua County (TW)

(72) Inventor: Yu Chi Chen, Changhua County (TW)

(73) Assignee: Solite International Co., Ltd., Changhua (TW)

( * ) Notice: Subject to any disclaimer, the term of this patent is extended or adjusted under 35 U.S.C. 154(b) by 3 days.

(21) Appl. No.: 15/131,066

(22) Filed: Apr. 18, 2016

(65) Prior Publication Data

US 2017/0295899 A1 Oct. 19, 2017

(51) Int. Cl.
*A45C 5/03* (2006.01)
*A45C 7/00* (2006.01)

(52) U.S. Cl.
CPC ..... *A45C 7/0022* (2013.01); *A45C 5/03* (2013.01)

(58) Field of Classification Search
CPC ..... A45C 7/0022; A45C 7/0036; A45C 5/03
USPC ..... 190/103, 105, 107
See application file for complete search history.

(56) References Cited

U.S. PATENT DOCUMENTS 892,125 A * 6/1908 Bourne ..... A45C 7/0031 190/104
1,240,210 A * 9/1917 Harvey ..... E04G 11/56 254/101
1,573,721 A * 2/1926 Loeffler ..... A45C 7/0036 190/107
4,630,717 A * 12/1986 Tong ..... A45C 7/0031 190/104
5,303,805 A * 4/1994 Hauser ..... A45C 3/004 190/107
7,195,109 B2 * 3/2007 Mitchell ..... A45C 5/14 190/103
8,820,498 B2 * 9/2014 Benshetrit ..... A45C 7/0018 190/103
2016/0213110 A1 * 7/2016 Wong ..... A45C 5/03

FOREIGN PATENT DOCUMENTS

TW M458136 U 8/2013

* cited by examiner

*Primary Examiner* — Sue A Weaver
(74) *Attorney, Agent, or Firm* — Adam D. Kamrath; Kamrath IP Lawfirm, P.A.

(57) ABSTRACT

A luggage container includes a body. The body defines an interior space for carrying articles. The body is expandable and contractible. An adjusting system is configured for adjusting the interior space. The adjusting system includes a first support device, a second supporting device, and a control input. The first and second supporting devices are mounted on the body and are spaced apart from each other at a distance. The control input is configured to be operable to selectively pull the first and second supporting devices towards each other and push the first and second supporting devices away from each other. The control input and the first and second supporting devices include a connecting member connected therebetween. The connecting member interconnects the first and second supporting devices. The connecting member is flexible. The distance between the first and second supporting devices determines the volume of the interior space.

10 Claims, 11 Drawing Sheets

LUGGAGE CONTAINER WITH ADJUSTABLE INTERIOR SPACE

BACKGROUND OF THE INVENTION

1. Field of the Invention

The present invention relates to a luggage container and, particularly, to an expandable and contractible luggage container such that an interior space of the luggage container is adapted to be adjusted.

2. Description of the Related Art

Taiwan Pat. No. M458136 shows an expandable luggage container. The expandable luggage container includes a luggage cover, a secondary cover and an extension fabric interconnecting the secondary cover and the luggage cover through zippers. The secondary cover can be moved further from the luggage cover to increase the volume of an interior space of the expandable luggage container.

It is not easy for a user to adjust the interior space of the language container. In order to increase the volume of the interior space, the user has to unzip the zippers to allow the extension fabric to be stretched. Furthermore, tucking the extension fabric into the luggage cover and the secondary cover is not easy, and closing the zippers can abrade the extension fabric. In addition, it is impossible for the user to adjust the interior space with one hand.

The present invention is, therefore, intended to obviate or at least alleviate the problems encountered in the prior art.

SUMMARY OF THE INVENTION

According to the present invention, a luggage container with adjustable interior space includes a compartment structure including a body. The body defines an interior space for carrying articles. The body is expandable and contractible. A cover is attached to the body. The body includes an opening, and the cover is configured to selectively open and close the opening. The opening defines a side of the interior space. An adjusting system is connected to the compartment structure and is configured for adjusting the interior space. The adjusting system includes a first support device, a second supporting device, and a control input. The first and second supporting devices are mounted on the body and are spaced apart from each other at a distance. The control input is configured to be operable to selectively pull the first and second supporting devices towards each other and push the first and second supporting devices away from each other. The control input and the first and second supporting devices include a connecting member connected therebetween. The connecting member interconnects the first and second supporting devices. The connecting member is flexible. The distance between the first and second supporting devices determines the volume of the interior space. The volume of the interior space is expanded when the first and second supporting devices are pushed away from each other. The volume of interior space is contracted when the first and second supporting devices are pushed towards each other.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially the scientists, engineers and practitioners in the art who are not familiar with patent or legal terms or phraseology, to determine quickly from a cursory inspection the nature and essence of the technical disclosure. The abstract is neither intended to define the invention, which is measured by the claims, nor is it intended to be limiting as to the scope of the invention in any way.

It is therefore an objective of the present invention to provide a luggage container with an adjustable interior space for carrying articles.

It is another objective of the present invention that the interior space can be adjusted quickly and easily.

Other objectives, advantages, and new features of the present invention will become apparent from the following detailed description of the invention when considered in conjunction with the accompanied drawings.

DETAILED DESCRIPTION OF THE INVENTION

Figure 1:
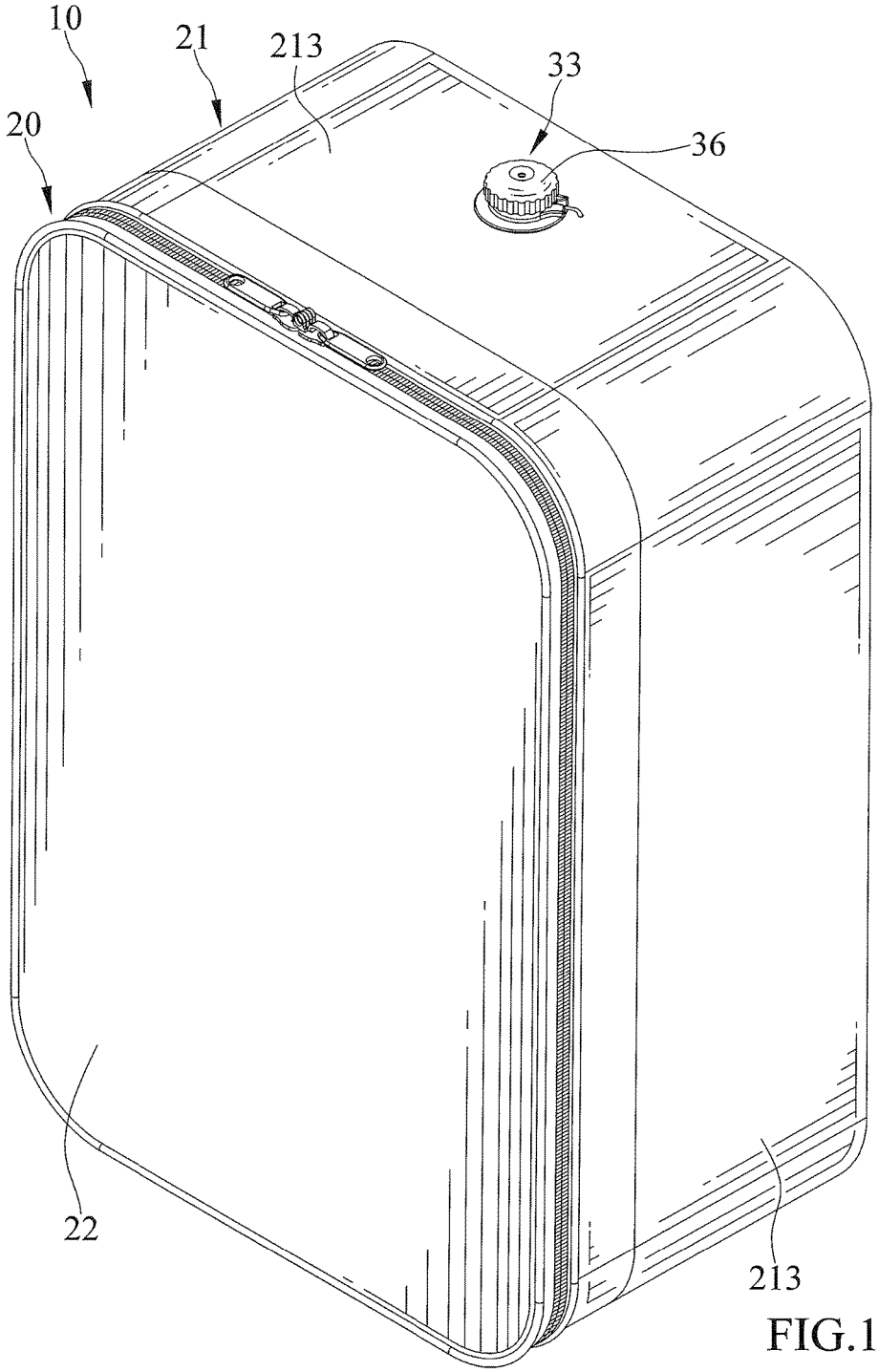
FIG. 1 is a perspective view of a luggage container with an adjustable interior space in accordance with the present invention.
Figure 2:
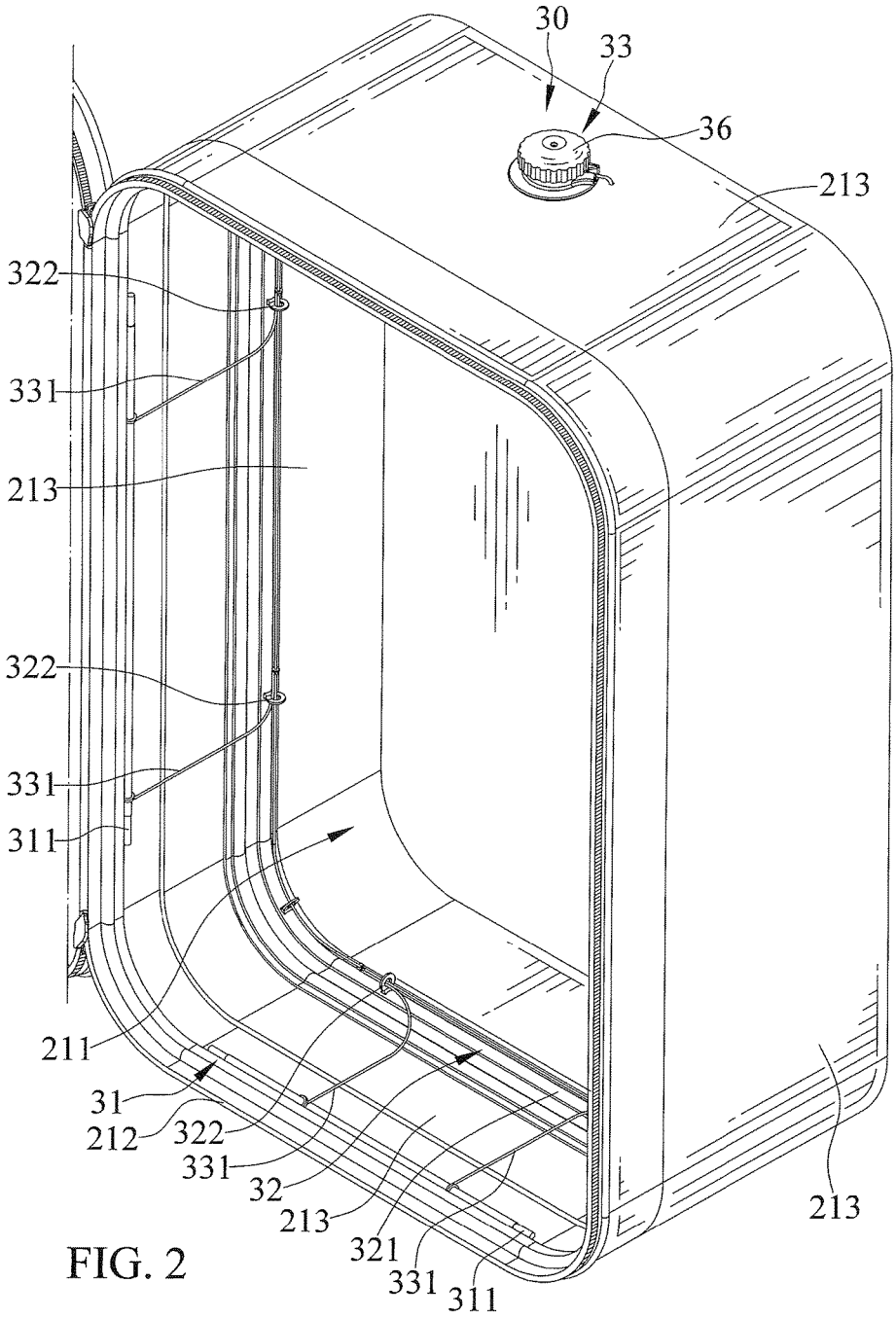
FIG. 2 is a partial, perspective view showing a cover of the luggage container in an open position.
Figure 3:
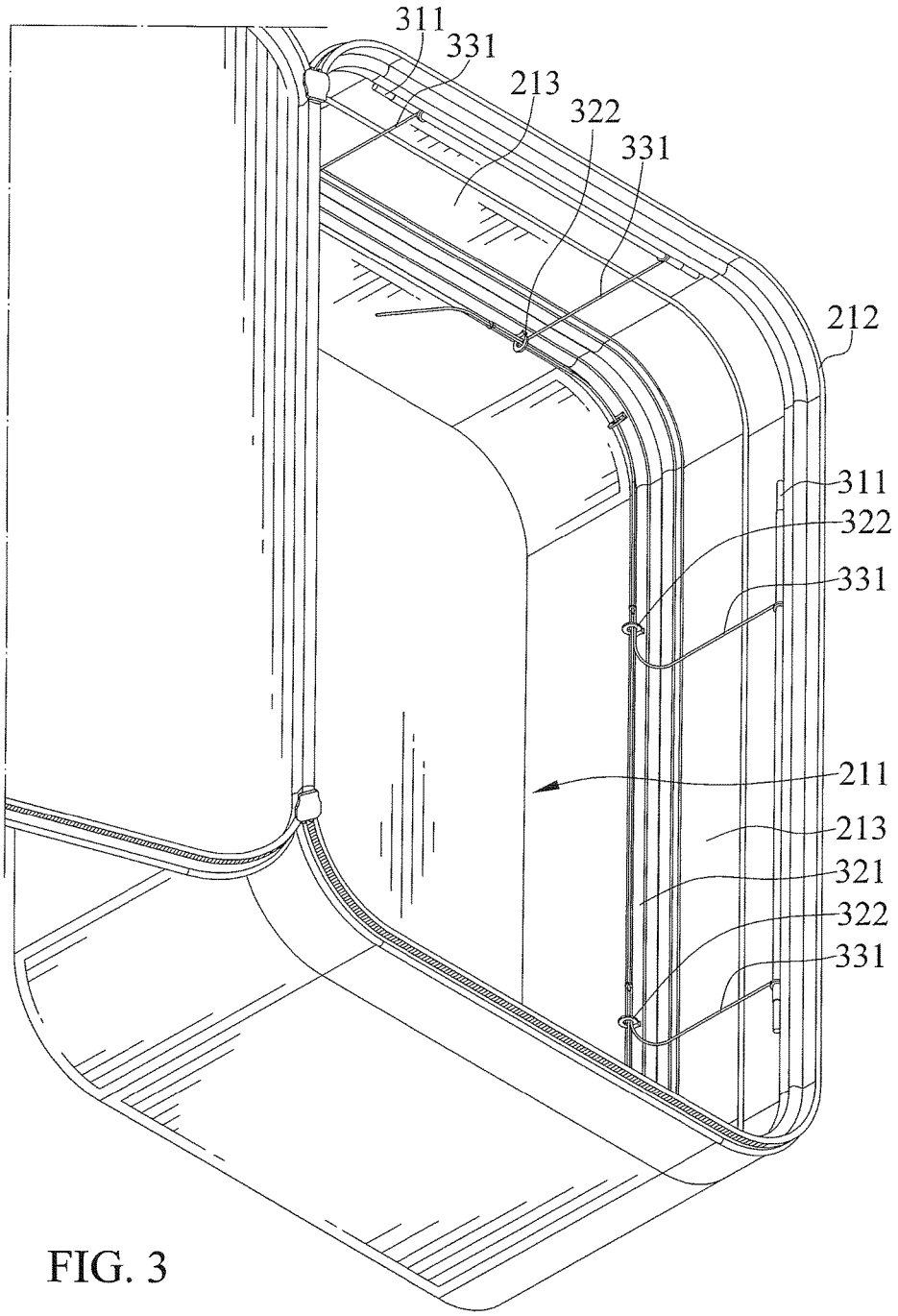
FIG. 3 is a partial, perspective view of the luggage container similar to FIG. 2, but viewed at different angles.
Figure 4:
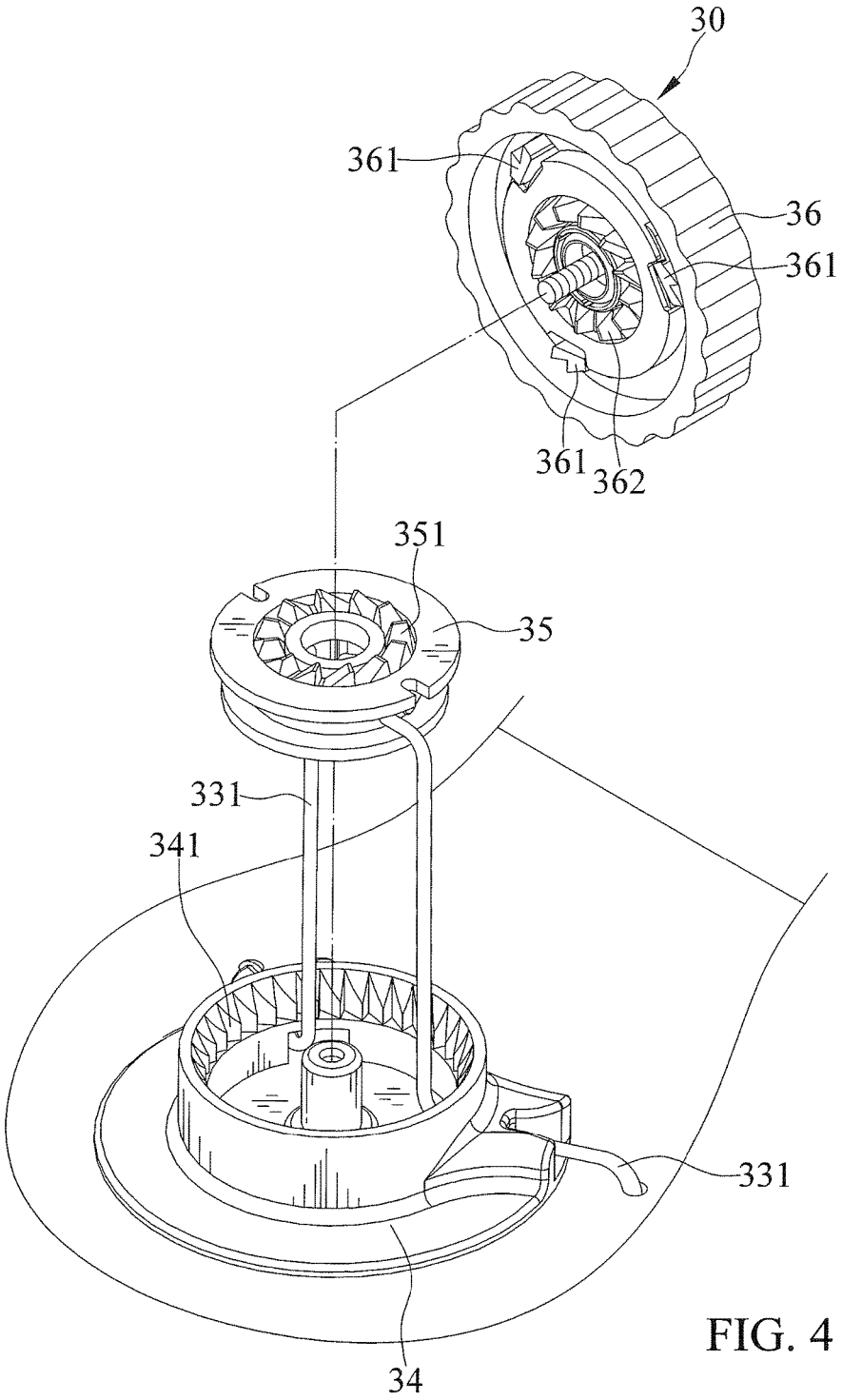
FIG. 4 is a partial, exploded, perspective view of an adjusting system of the luggage container for adjusting an interior space of the luggage container.
Figure 5:
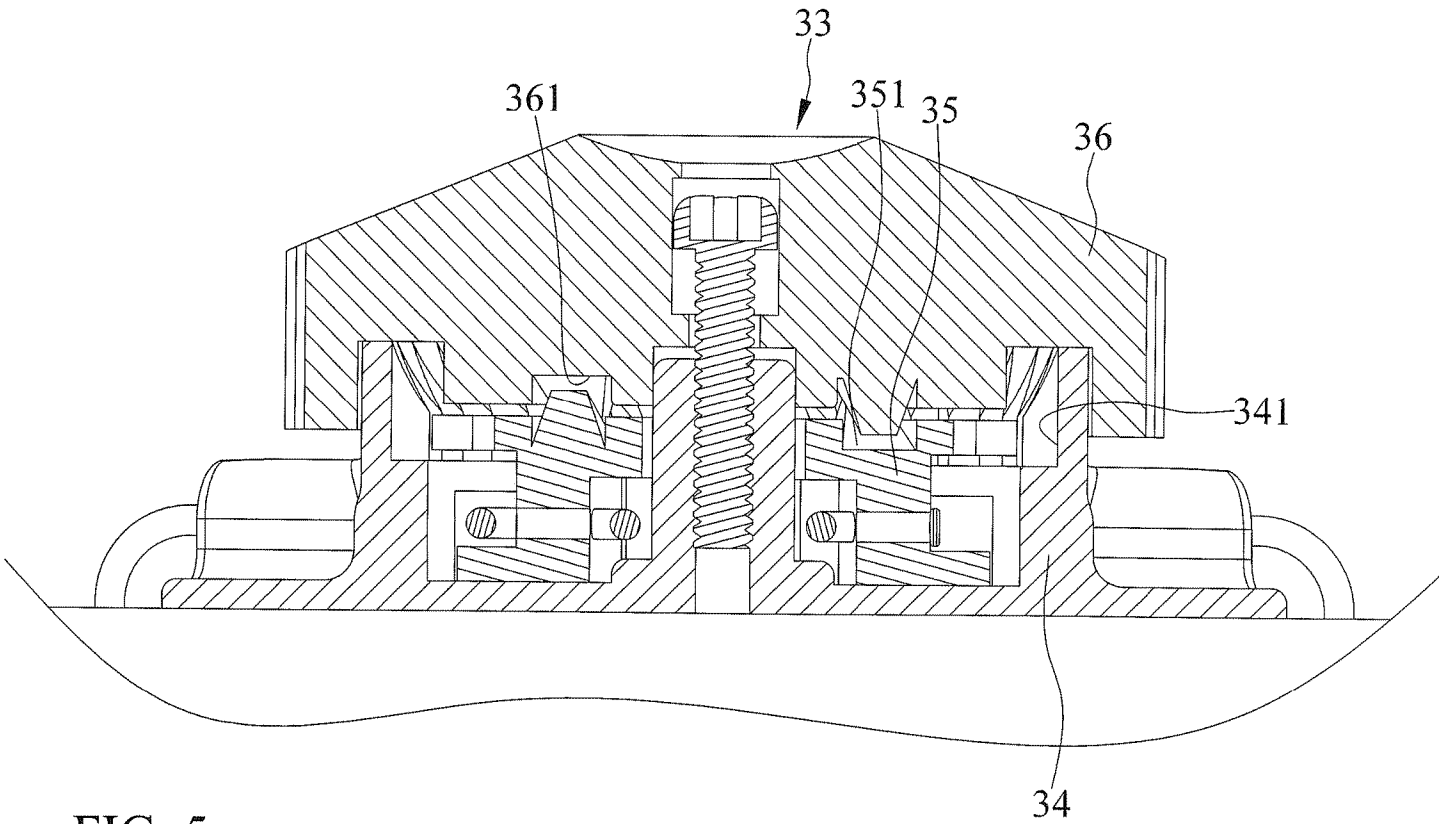
FIG. 5 is a partial, cross-sectional view of the adjusting system shown in FIG. 4.
Figure 6:
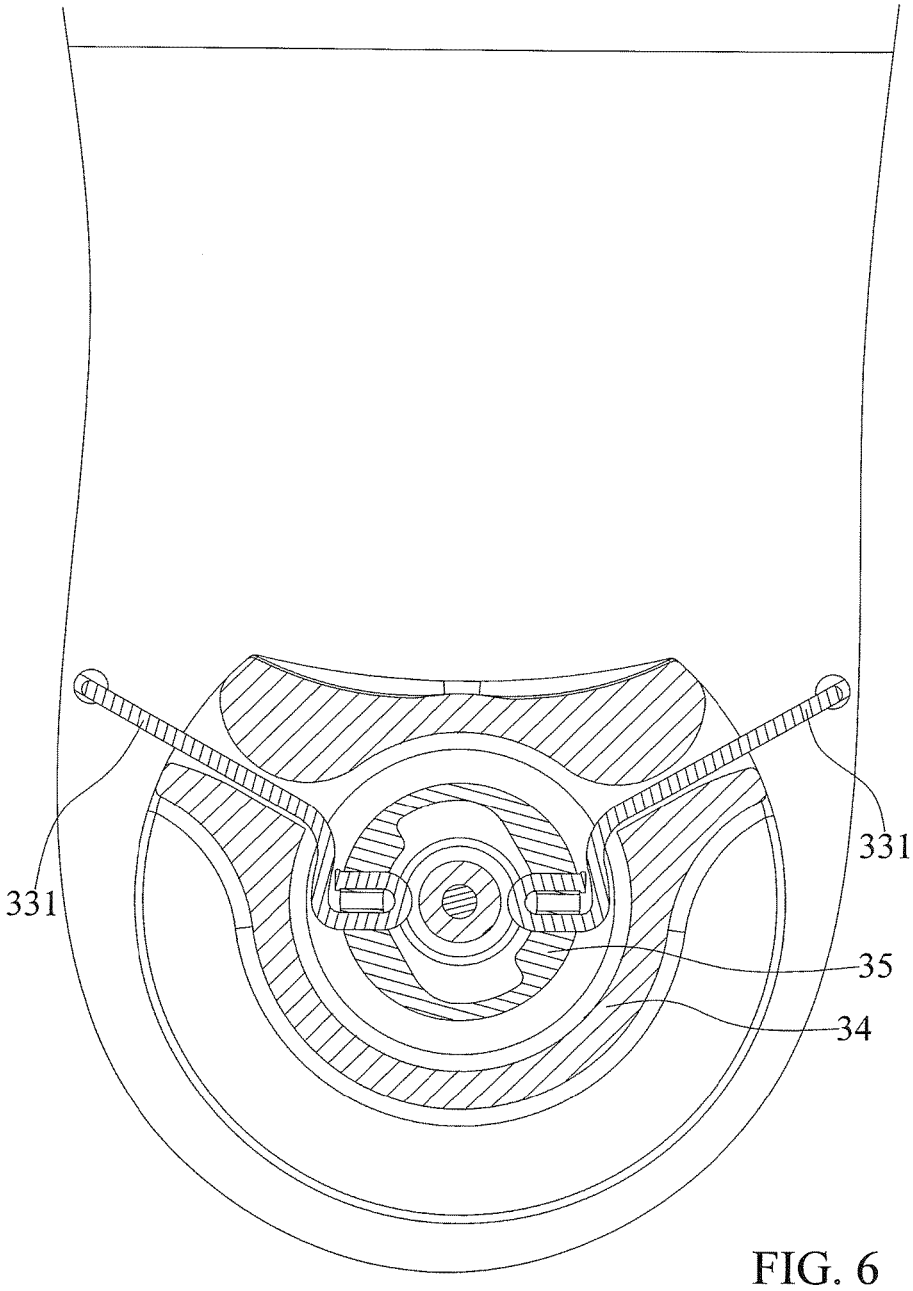
FIG. 6 is another partial, cross-sectional view of the adjusting system shown in FIG. 4.
Figure 7:
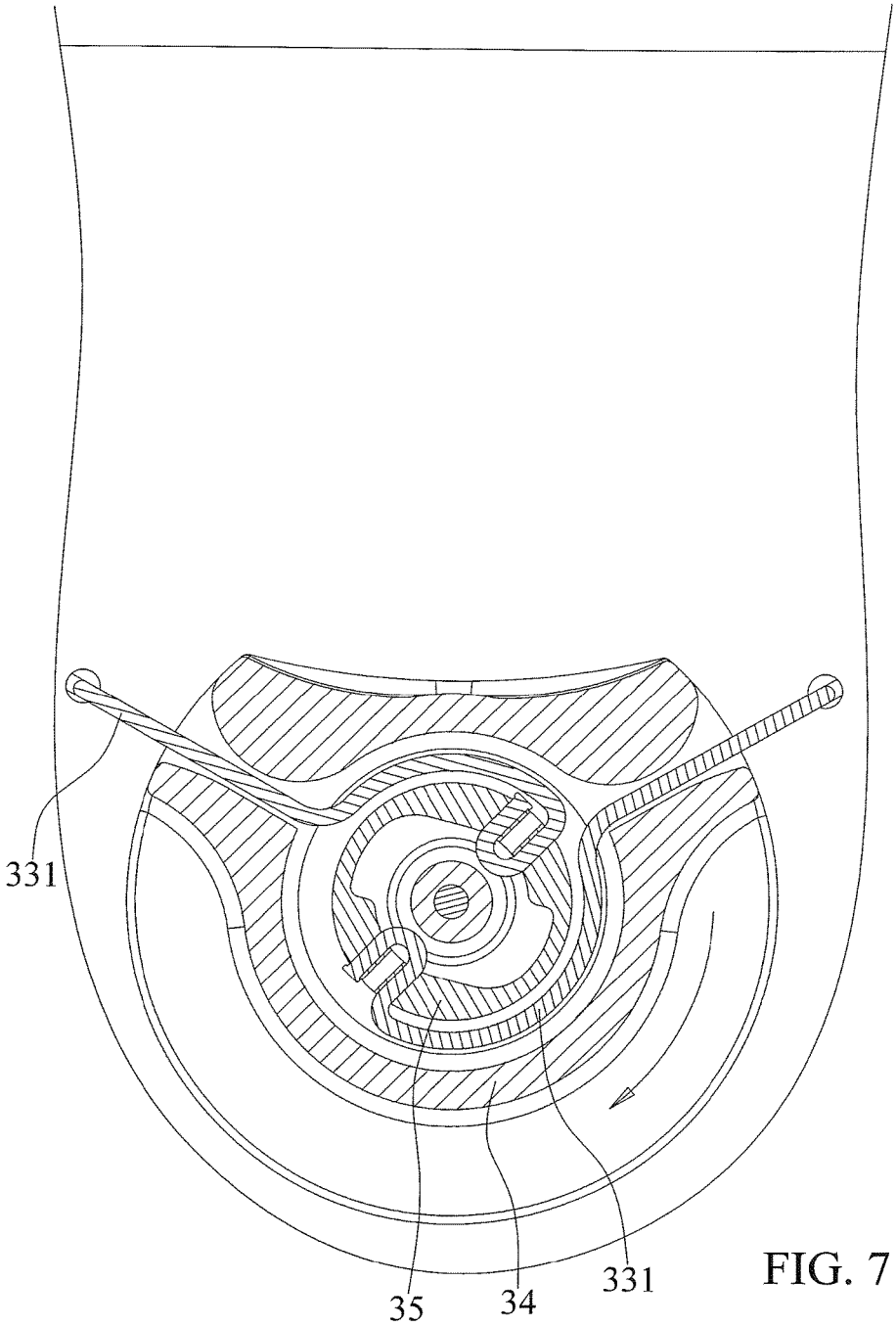
FIG. 7 is a partial, cross-sectional view showing the adjusting system in an operation decreasing the volume of the interior space of the luggage container.
Figure 8:
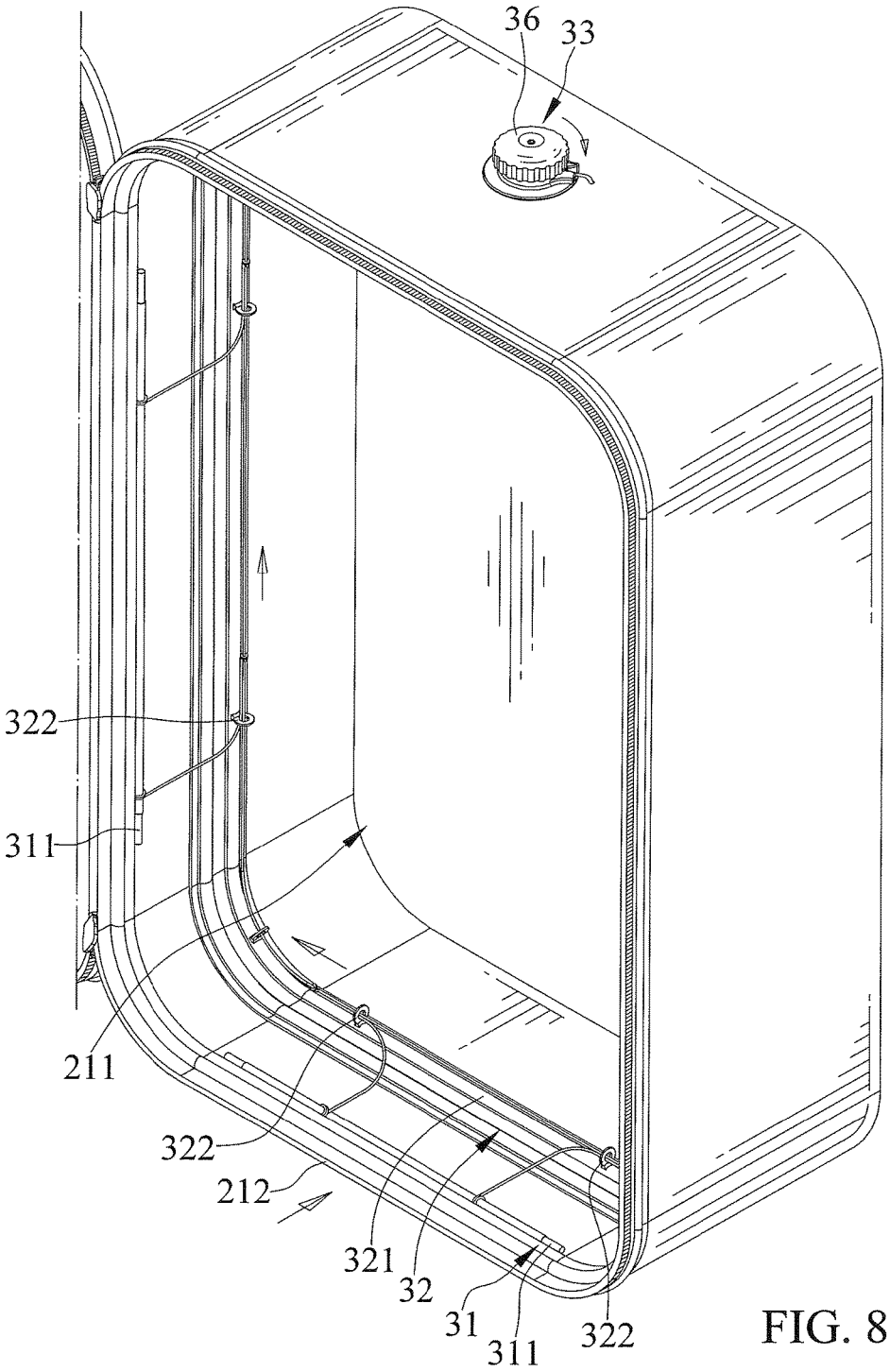
FIG. 8 is a perspective view showing the adjusting system in the operation decreasing the volume of the interior space of the luggage container.
Figure 9:
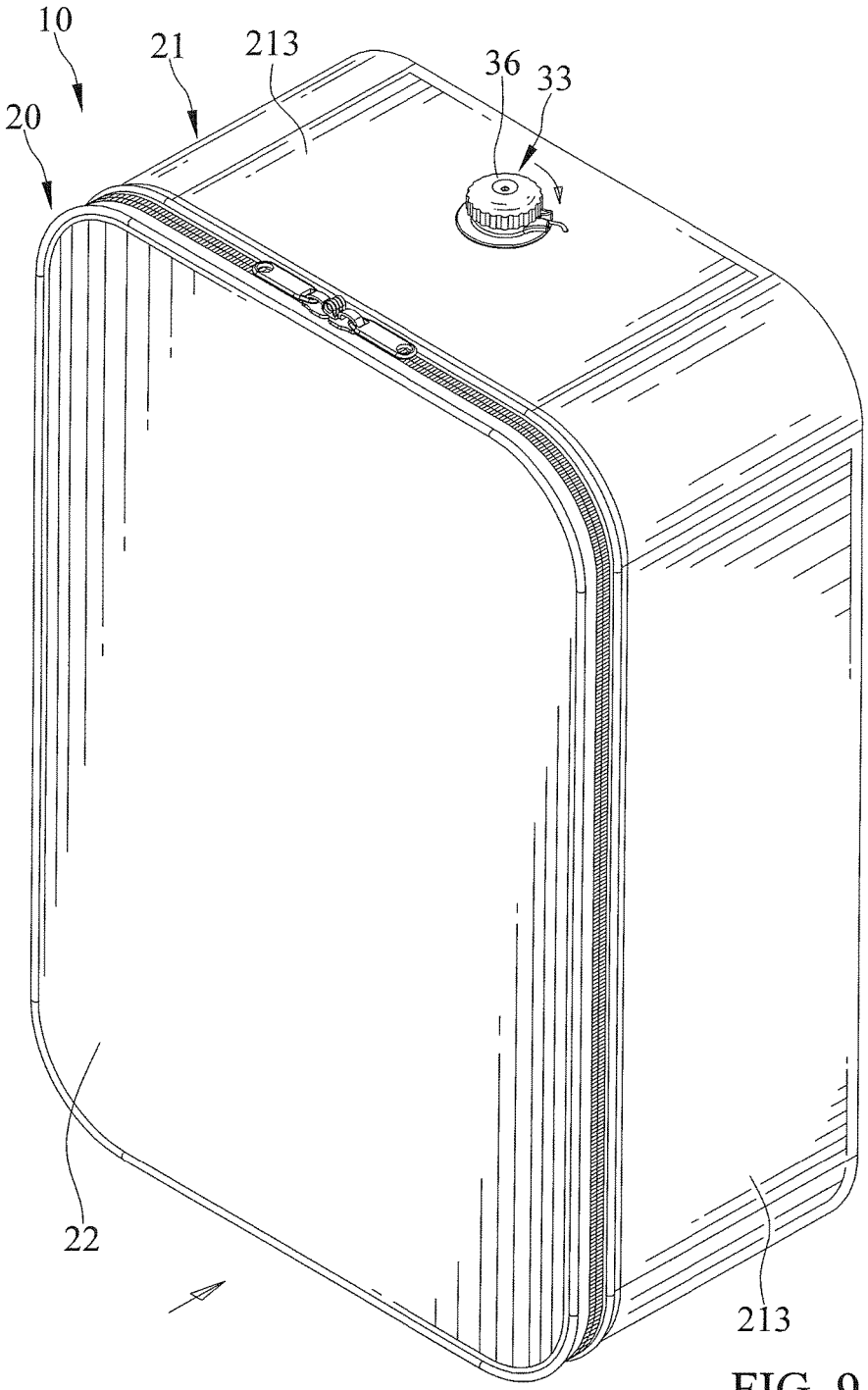
FIG. 9 is another perspective view showing the adjusting system in the operation decreasing the volume of the interior space of the luggage container.
Figure 10:
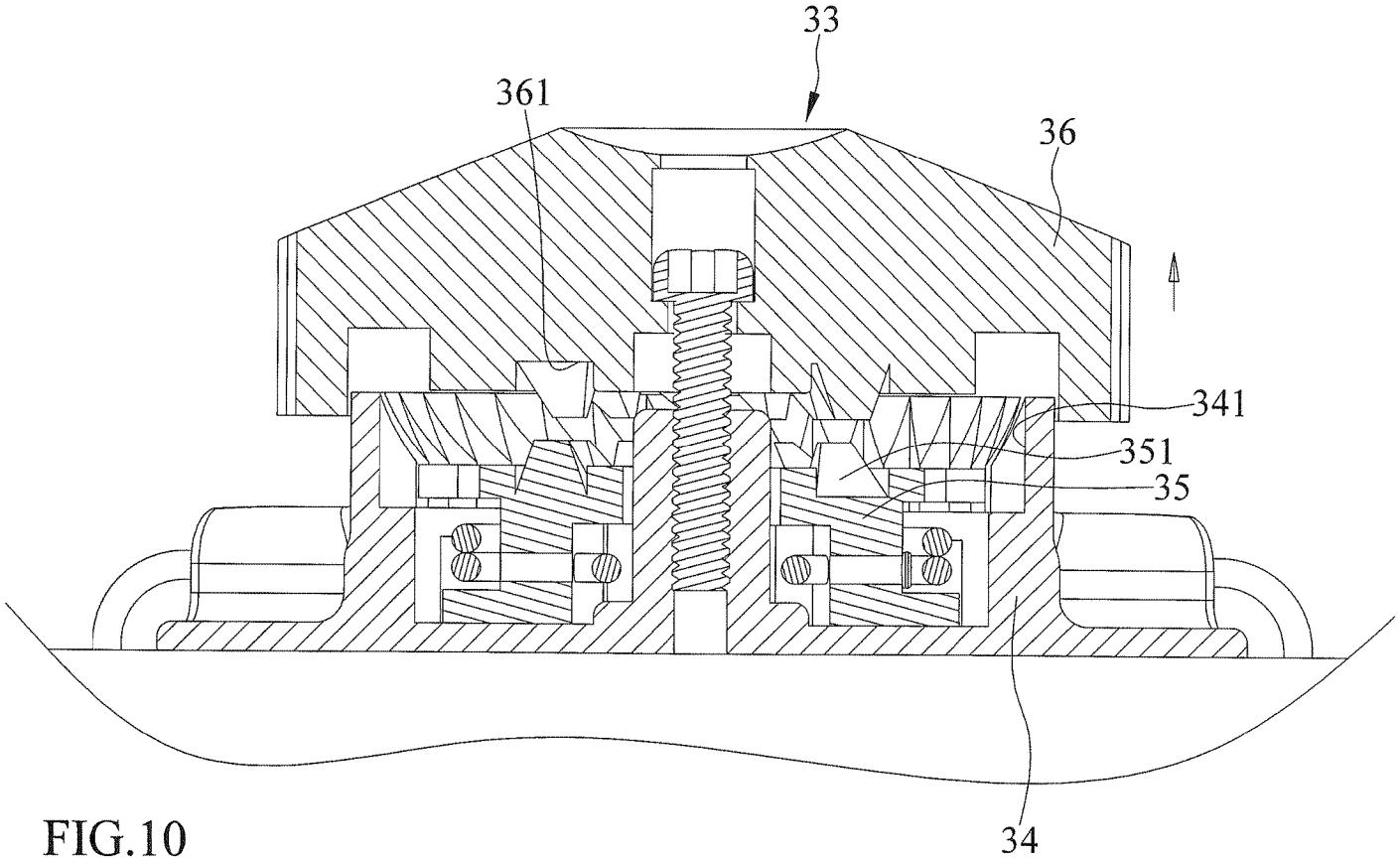
FIG. 10 is a cross-sectional view showing the adjusting system in an operation increasing the volume of the interior space of the luggage container.
Figure 11:
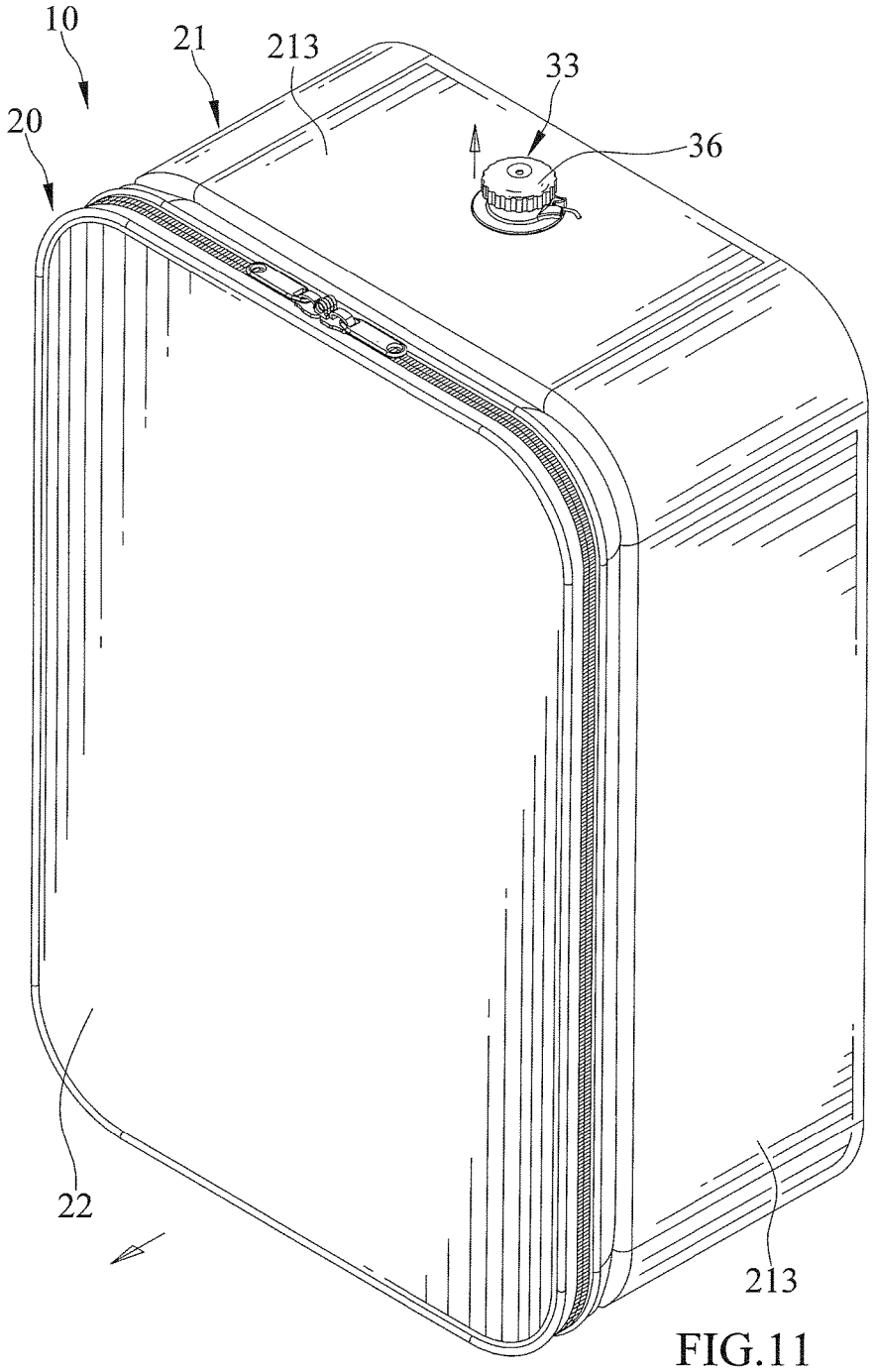
FIG. 11 is a perspective view showing the adjusting system in the operation increasing the volume of the interior space of the luggage container.

FIGS. 1 through 11 show a luggage container with an adjustable interior space in accordance with the present invention. The luggage container 10 includes a compartment structure 20. The compartment structure 20 includes a body 21 and a cover 22 is attached to the body 21. The body 21 defines an interior space 211 for carrying articles. The body 21 is expandable and contractible. In the embodiment, the body 21 has a lateral side 213 being expandable and contractible. The body 21 includes an opening 212, and the cover 22 is configured to selectively open and close the opening 212. Therefore, the interior space 211 is closed when the cover 22 closes the opening 212, and the interior space 211 is open when the cover 22 does not close the opening 212. The opening 212 defines a side of the interior space 211. The body 21 has a front end, and the opening 212 is at the front end of the body 21. The body 21 has a back end spaced from the front end, and the interior space 211 extends between the front and back ends of the body 21. The body 21 includes the lateral side 213 thereof extending between the front and back ends thereof.

The luggage container 10 also includes an adjusting system 30 connected to the compartment structure 20 and configured for adjusting the interior space 211. When the volume of the interior space 211 is expanded, the lateral side 213 of the body 21 is extended and has a first width in a width direction thereof. When the volume of the interior space 211 is contracted, the lateral side 213 of the body 21 is contracted and has a second width in the width direction thereof. The second width is smaller than the first width.

The adjusting system 30 includes a first support device 31, a second supporting device 32, and a control input 33. The first and second supporting devices 31 and 32 are mounted on the body 21 and are spaced apart from each other at a distance. The first and second supporting devices 31 and 32 are mounted on the lateral side 213 of the body 21, and are spaced in the width direction of the lateral side 213 of the body 21. The first supporting device 31 includes at least one strut 311 attached to the lateral side 213 of the body 21 and the second supporting device 32 includes a frame 321 attached to the lateral side 213 of the body 21. The second supporting device 32 includes at least one retainer 322 disposed on the frame 321 and configured for securing the connecting member 331 to the frame 321. The connecting member 331 is linked to the at least one strut 311. The frame 321 has a closed annular periphery. The frame 321 has an advantage of reinforcing the body 21. The at least one retainer 322 is in a form of a ring, and the connecting member 331 is inserted through the ring.

The adjusting system 30 also includes a control input 33 configured to be operable to selectively pull the first and second supporting devices 31 and 32 towards each other and push the first and second supporting devices 31 and 32 away from each other. The control input 33 and the first and second supporting devices 31 and 32 include a connecting member 331 connected therebetween. The connecting member 331 interconnects the first and second supporting devices 31 and 32. The connecting member 331 is flexible. The connecting member 331 is a metal wire. The control input 33 includes a base seat 34 including a floor surface mounted on the body 21 and including gears 341. The base seat 34 has an annular inner periphery, and the gears 341 are disposed annularly on the inner periphery of the base seat 34. The base seat 34 includes a compartment and a pivot in the compartment. The control input 33 includes a winch 35 including a first mating structure 351 and being rotatable. The winch 35 is mounted in the compartment and is pivotally connected to the pivot, such that the winch 35 is rotatable about the pivot. The winch 35 includes a joining structure for pivotally connecting to the pivot. The joining structure is in a form of a hole, and the pivot is inserted in the hole. The connecting member 331 includes a first end thereof fastened to the winch 35 and is selectively wound in and wound out upon pivotal movement of the winch 35. The control input 33 includes a knob 36 configured to be operable to selectively rotate with the winch 35 and relative to the winch 35. The knob 36 includes at least one pawl 361 adapted to releasably engage with the gears 341 and a second mating structure 362 adapted to releasably engage with the first mating structure 351. The at least one pawl 361 includes a plurality of pawls 361. The plurality of pawls 361 is arranged in a spaced relationship annularly. The knob 36 is movable to a first position in which the at least one pawl 361 engages with the gears 341, and the first and second mating structures 351 and 362 are mated, such that the knob 36 and the winch 35 rotate together in one direction. The knob 36 is also moveable to a second position in which the at least one pawl 361 disengages from the gears 341 and the first and second mating structures 351 and 362 disengage from each other.

The distance between the first and second supporting devices 31 and 32 determines the volume of the interior space 211. The volume of the interior space 211 is expanded when the first and second supporting devices 31 and 32 are pushed away from each other. The volume of interior space 211 is contracted when the first and second supporting devices 31 and 32 are pushed towards each other.

In view of the forgoing, the interior space 211 defined in the luggage container 10 can be selectively expanded and contracted. Furthermore, the adjusting system 30 allows the interior space 211 to be adjusted quickly and easily.

The foregoing is merely illustrative of the principles of this invention, and various modifications can be made by those skilled in the art without departing from the scope and spirit of the invention.

What is claimed is:

1. A luggage container comprising:

a compartment structure including a body and a cover, with the body defining an interior space for carrying articles, with the body being expandable and contractible, with the cover attached to the body, with the body including an opening, with the cover configured to selectively open and close the opening, and with the opening defining a side of the interior space; and an adjusting system connected to the compartment structure and configured for adjusting the interior space, wherein the adjusting system includes a first support device, a second supporting device, and a control input, with the first and second supporting devices mounted on the body and spaced apart from each other at a distance, wherein the control input is configured to be operable to selectively pull the first and second supporting devices towards each other and push the first and second supporting devices away from each other, with the control input and the first and second supporting devices including a connecting member connected therebetween, with the connecting member interconnecting the first and second supporting devices, and with the connecting member being flexible;

wherein a distance between the first and second supporting devices determines the volume of the interior space, with the volume of the interior space being expanded when the first and second supporting devices are pushed away from each other, and with the volume of interior space being contracted when the first and second supporting devices are pushed towards each other;

wherein the control input includes a base seat including a floor surface mounted on the body and including gears, wherein the control input includes a winch including a first mating structure and is rotatable, wherein the connecting member includes a first end thereof fastened to the winch and is selectively wound in and wound out upon pivotal movement of the winch, wherein the control input includes a knob configured to be operable to selectively rotate with the winch and relative to the winch, with the knob including at least one pawl adapted to releasably engage with the gears and a second mating structure adapted to releasably engage with the first mating structure, with the knob being movable to a first position in which the at least one pawl engages with the gears and the first and second mating structures are mated such that the knob and the winch rotate together in one direction, and with the knob movable to a second position in which the at least one pawl disengages from the gears and the first and second mating structures disengage from each other; and wherein the base seat includes a compartment and a pivot in the compartment, and wherein the winch is mounted in the compartment and is pivotally connected to the pivot such that the winch is rotatable about the pivot.

2. The luggage container as claimed in claim 1, wherein the body has a lateral side being expandable and contractible, wherein when the body is expanded and the volume of the interior space is expanded, the lateral side of the body is extended and has a first width in a width direction thereof, wherein when the body is contracted and the volume of the interior space is contracted, the lateral side of the body is contracted and has a second width in the width direction thereof, and wherein the second width is smaller than the first width.

3. The luggage container as claimed in claim 2, wherein the first and second supporting devices are mounted on the lateral side of the body and are spaced in the width direction of the lateral side of the body.

4. The luggage container as claimed in claim 3, wherein the body has a front end, wherein the opening is at the front end of the body, wherein the body has a back end spaced from the front end and the interior space extends between the front and back ends of the body, and wherein the body includes the lateral side thereof extending between the front and back ends thereof.

5. The luggage container as claimed in claim 3, wherein the first supporting device includes at least one strut attached to the lateral side of the body and the second supporting device includes a frame attached to the lateral side of the body, wherein the second supporting device includes at least one retainer disposed on the frame and configured for securing the connecting member to the frame, and wherein the connecting member is linked to the at least one strut.

6. The luggage container as claimed in claim 5, wherein the frame has a closed annular periphery.

7. The luggage container as claimed in claim 5, wherein the at least one retainer is in a form of a ring and the connecting member is inserted through the ring.

8. The luggage container as claimed in claim 1, wherein the base seat has an annular inner periphery and the gears are disposed annularly on the inner periphery of the base seat.

9. A luggage container comprising:

a compartment structure including a body and a cover, with the body defining an interior space for carrying articles, with the body being expandable and contractible, with the cover attached to the body, with the body including an opening, with the cover configured to selectively open and close the opening, and with the opening defining a side of the interior space; and an adjusting system connected to the compartment structure and configured for adjusting the interior space, wherein the adjusting system includes a first support device, a second supporting device, and a control input, with the first and second supporting devices mounted on the body and spaced apart from each other at a distance, wherein the control input is configured to be operable to selectively pull the first and second supporting devices towards each other and push the first and second supporting devices away from each other, with the control input and the first and second supporting devices including a connecting member connected therebetween, with the connecting member interconnecting the first and second supporting devices, and with the connecting member being flexible;

wherein a distance between the first and second supporting devices determines the volume of the interior space, with the volume of the interior space being expanded when the first and second supporting devices are pushed away from each other, and with the volume of interior space being contracted when the first and second supporting devices are pushed towards each other;

wherein the control input includes a base seat including a floor surface mounted on the body and including gears, wherein the control input includes a winch including a first mating structure and is rotatable, wherein the connecting member includes a first end thereof fastened to the winch and is selectively wound in and wound out upon pivotal movement of the winch, wherein the control input includes a knob configured to be operable to selectively rotate with the winch and relative to the winch, with the knob including at least one pawl adapted to releasably engage with the gears and a second mating structure adapted to releasably engage with the first mating structure, with the knob being movable to a first position in which the at least one pawl engages with the gears and the first and second mating structures are mated such that the knob and the winch rotate together in one direction, and with the knob movable to a second position in which the at least one pawl disengages from the gears and the first and second mating structures disengage from each other;

wherein the base seat has an annular inner periphery and the gears are disposed annularly on the inner periphery of the base seat; and wherein the at least one pawl includes a plurality of pawls, and wherein the plurality of pawls is arranged in a spaced relationship annularly.

10. The luggage container as claimed in claim 9, wherein the connecting member is a metal wire.

* * * * *